United States Patent [19]

Matsuyama et al.

[11] Patent Number: 4,668,537

[45] Date of Patent: May 26, 1987

[54] METHOD AND APPARATUS FOR APPLYING A RELEASING AGENT

[75] Inventors: Fumio Matsuyama; Chiaki Kato, both of Osaka, Japan

[73] Assignee: Sumitomo Electric Industries, Ltd., Osaka, Japan

[21] Appl. No.: 743,379

[22] Filed: Jun. 11, 1985

[30] Foreign Application Priority Data

Jun. 18, 1984 [JP] Japan ..... 59-125675

[51] Int. Cl.[4] ..... B05D 1/28; G03G 15/20

[52] U.S. Cl. ..... 427/401; 118/60; 118/260; 118/264; 156/290; 427/429; 432/60

[58] Field of Search ..... 118/60, 260, 264, 70, 118/101; 432/60; 219/216; 156/290; 427/401, 429

[56] References Cited

U.S. PATENT DOCUMENTS 4,182,263 1/1980 Naeser et al. ..... 118/60
4,309,957 1/1982 Swift ..... 432/60 X
4,359,963 11/1982 Saito et al. ..... 118/60

FOREIGN PATENT DOCUMENTS 3016098 11/1980 Fed. Rep. of Germany .

OTHER PUBLICATIONS

Patents Abstracts of Japan, vol. 7, No. 23 (P-171)[1168], 29th Jan. 1983; Abstract of No. JP-A 57-177174 (Canon K.K.), 30-10-1982.

Patents Abstracts of Japan, vol. 5, No. 32 (P-50)[704], 27th Feb. 1981; Abstract of No. JP-A 55-153974 (Canon K.K.) 01-12-1980.

*Primary Examiner*—Evan K. Lawrence

*Attorney, Agent, or Firm*—Cushman, Darby & Cushman

[57] ABSTRACT

A releasing agent applicator for a toner fixing apparatus including a hot fixing roller and an elastic pressing roller between which toner, transferred onto copying paper, is fixed. It includes a heat resistant felt for holding a releasing agent. A porous polymer membrane is disposed between the felt and the fixing roller. A heat resistant polymer film is thermally fused between the felt and the membrane to bond the membrane to the felt except that portion of the membrane which is brought into contact with the fixing roller. The felt is impregnated with releasing agent and that portion of the membrane without the film may be brought into contact with the fixing roller to allow the releasing agent to be applied to the fixing roller.

7 Claims, 7 Drawing Figures

PRIOA ART

METHOD AND APPARATUS FOR APPLYING A RELEASING AGENT

BACKGROUND OF THE INVENTION

1. Field of the Invention

This invention relates to a releasing agent applicator for use in, for example, a plain paper copying machine or a facsimile apparatus, and a method of applying releasing agent with the applicator.

2. Description of the Prior Art

Referring to FIG. 5, a fixing mechanism in a plain paper copying machine essentially comprises a hot fixing roller 1 and an electric pressing roller 13, such as a rubber roller. Paper 11 is passed between the rollers 1 and 13 and heated under pressure, whereby the toner 12 which has been transferred onto the paper 11 is fixed. It also includes a blade 14 and a peeling pawl 15.

When the paper is fed between the rollers, it is likely to stick to, and get wound on, the roller or rollers resulting in the failure of the toner to be properly fixed. It is also likely that the toner may adhere to the fixing roller and thereby cause the formation of a double image (the so-called offset phenomenon). It is, therefore, usual to apply a releasing agent to the fixing and pressing rollers. Silicone oil is usually used as the releasing agent.

A conventional device for applying a releasing agent to those rollers in a low-speed general-purpose copying machine comprises a heat resistant felt 3 impregnated with silicone oil and attached to a housing 2 formed from a heat resistant plastic or metal, as shown in FIG. 4. It is simple in construction and inexpensive. This device has, however, a number of drawbacks as will hereunder be pointed out.

(1) The toner which has been offset on the fixing roller clogs that surface of the felt which is brought into contact with the roller, and disables the felt to apply oil to the roller. The toner adhering to the felt damages the surface face of the fixing roller. Therefore, it is necessary to change the felt as often as each time about 10,000 sheets of paper have been printed.

(2) It is impossible to adjust the amcunt of oil which is applied to the roller.

SUMMARY OF THE INVENTION

It is an object of this invention to provide an improved releasing agent applicator and applying method which solves the drawbacks of the prior art as hereinabove pointed out.

This object is attained by a device which includes a porous polymer membrane disposed between a heat resistant felt for holding a releasing agent and a fixing roller, and a heat resistant polymer film by which the membrane is thermally fused to the felt, except that portion of the membrane which is brought into contact with the fixing roller. The felt may then be impregnated with a releasing agent and the assembly may be placed contiguous with the fixing roller to cause releasing agent to be applied to the roller.

This invention has the following advantages:

(1) The felt has a long life without being clogged if it is appropriately supplied with oil; and (2) It is possible to adjust the amount of oil which is applied to the roller.

BRIEF DESCRIPTION OF THE DRAWINGS

These and other objects and advantages of this invention will become more apparent and more readily appreciated from the following detailed description of the presently preferred explanary embodiment, taken in conjunction with the accompanying drawings of which.

DETAILED DESCRIPTION OF THE INVENTION

Figure 1A:
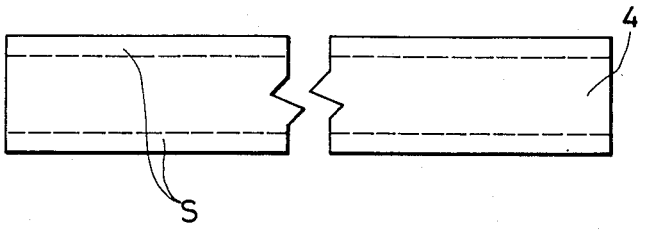
FIG. 1A is a front elevational view of a combination of a felt and a porous tetrafluoroethylene resin membrane bonded thereto according to this invention.
Figure 1B:
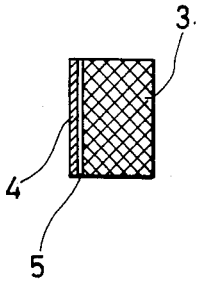
FIG. 1B is a side elevational view thereof.
Figure 2:
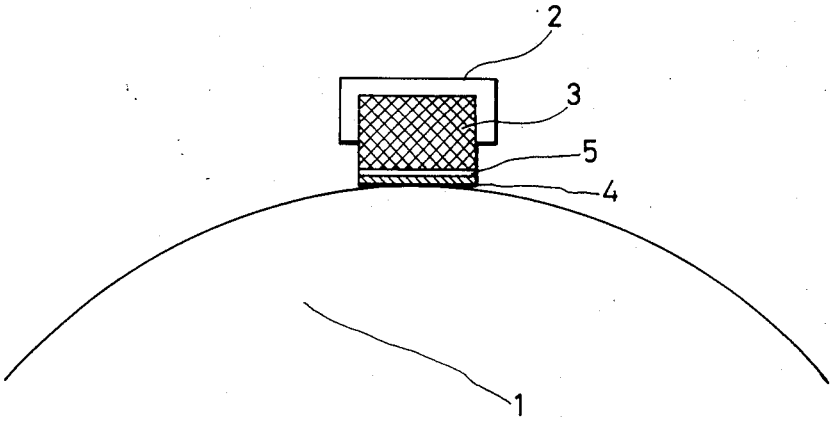
FIG. 2 is a side elevational view of a releasing agent applicator embodying this invention and including the combination of FIGS. 1A and 1B.

Referring to FIG. 2, a releasing agent applicator embodying this invention comprises a housing 2 and a heat resistant felt 3 attached thereto and impregnated with a releasing agent, usually silicone oil. A porous tetrafluoroethylene resin membrane 4 is disposed between a fixing roller 1 and felt 3 and a heat resistant polymer film 5, such as a film of FEP (tetrafluoroethylene-hexafluoropropylene copolymer), is thermally fused between felt 3 and membrane 4, as shown in FIGS. 1A and 1B. FEP film 5 is disposed between felt 3 and membrane 4 except that portion of membrane 4 which contacts fixing roller 1, so that oil may be supplied from felt 3 to roller 1 through membrane 4.

Porous tetrafluoroethylene membrane 4 keeps felt 3 from being clogged by the toner and provides it with improved protection against abrasion by roller 1. Those skilled in the art will readily appreciate that the applicator illustrated in FIG. 2 is a sliding-type applicator in that porous membrane 4 slides on roller 1, leading to the possibility of clogging and abrasion that this invention reduces. It is possible to adjust the amount of the releasing agent which is applied through membrane 4, if the pore diameter of membrane 4 and its porosity are appropriately selected.

The invention will now be described more specifically by way of example.

EXAMPLE

Figure 3A:
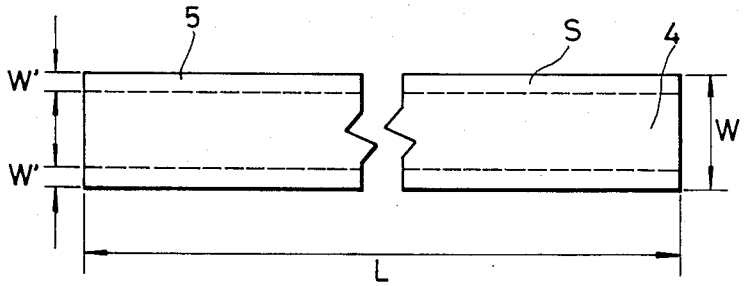
FIG. 3A is a front elevational view showing a specific example of this invention.
Figure 3B:
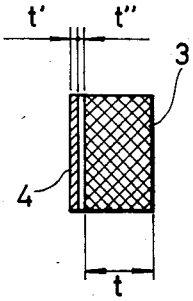
FIG. 3B is a side elevational view thereof.
Figure 4:
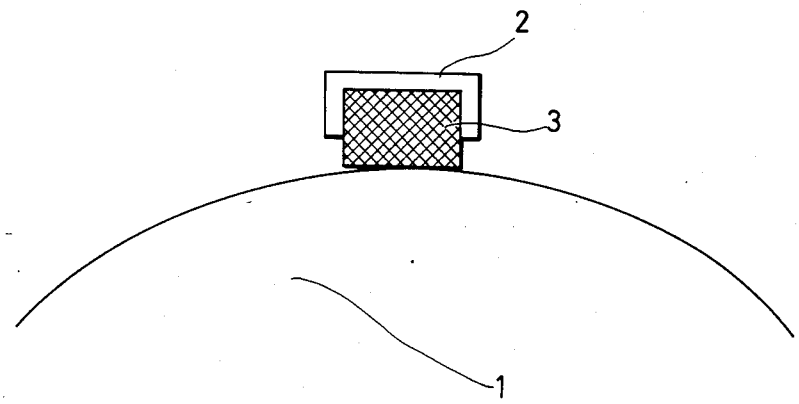
FIG. 4 is a side elevational view of a conventional applicator.
Figure 5:
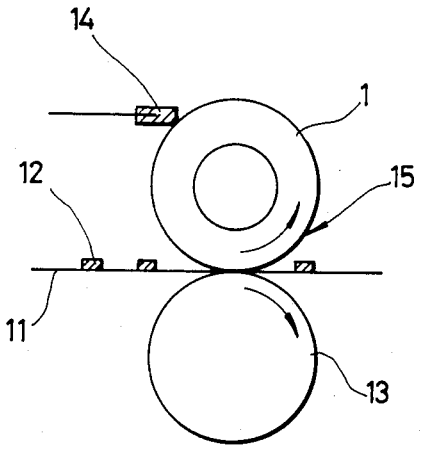
FIG. 5 PRIOR ART
FIG. 5 is a schematic view showing the general principle of a copying machine.

FEP film 5 (see FIGS. 3A and 3B) having a thickness (t″) of 25 μm and a width (W′) of 3 mm was disposed between a NORMEX felt 3 (product of Du Pont de Numors & Inc.) having a thickness (t) of 8 mm, a width (W) of 20 mm and a length (L) of 300 mm and a porous tetrafluoroethylene resin membrane 4 (product of SUMITOMO ELECTRIC INDUSTRIES, LTD. known as POREFLON) having a pore diameter of 0.5 μm, and a porosity of 70% and a thickness (t′) of 300 μm along each longitudinal edge of membrane 4. The whole was heated at a temperature of 320° C. to 400° C. under pressure, whereby membrane 4 was bonded to felt 3 along each longitudinal edge thereof with a bonding region S (see FIG. 1A) having a width of 3 mm. Felt 3 was impregnated with 20 g of dimethyl polysiloxane having a viscosity of 3000 cs and attached to housing 2 so that porous membrane 4 might face fixing roller 1.

The applicator constructed as hereinabove described was installed for a fixing roller in a plain paper copying machine. It was treated continuously for 50,000 sheets of paper. There was neither any separation of the membrane from the felt nor any clogging of the felt with the toner, but the felt was still usable if an appropriate supply of the releasing agent was continued. The test consumed about 15g of the releasing agent.

Although only a single embodiment of this invention has been described above in detail, those skilled in the art will appreciate that many modifications are possible within the spirit and teaching of this invention. Accordingly, all such modifications are intended to be included within the scope of this invention as defined by the following claims.

What is claimed is:

1. A sliding-type releasing agent applicator comprising:

a heat resistant felt for holding a releasing agent;

a porous polymer membrane; and means for binding said felt to said membrane, said binding means comprising a heat resistant fluorine-containing polymer film disposed between said felt and said membrane and thermally fused therewith to bond said membrane to said felt except for a predetermined portion of said membrane.

2. An applicator as set forth in claim 1, wherein said membrane is a porous tetrafluoroethylene resin membrane.

3. An applicator as set forth in claim 1, wherein said fluorine-containing polymer film is tetrafluoroethylene-hexafluoro-propylene copolymer.

4. Toner fixing apparatus comprising:

a rotatable hot fixing roller;

an elastic pressing roller diposed contiguous to said hot fixing roller, toner disposed on copying paper being fixed between said hot fixing roller and said elastic pressing roller; and an applicator for applying a releasing agent to said hot fixing roller as said applicator slides on the surface of said hot fixing roller including:

a heat resistant felt for holding said releasing agent, a porous polymer membrane disposed between said felt and said fixing roller, and means for binding said felt to said membrane, said binding means comprising a heat resistant fluorine-containing polymer film disposed between said felt and said membrane and thermally fused therewith to bond said membrane to said felt except that portion of said membrane which is brought into contact with said fixing roller.

5. An applicator as set forth in claim 4, wherein said membrane is a porous tetrafluoroethylene resin membrane

6. An applicator as set forth in claim 4, wherein said fluorine-containing polymer film is teterafluoroethylene-hexafluoro-propylene copolymer.

7. A method of applying releasing agent to a fixing roller comprising the steps of:

impregnating a heat resistant felt of an applicator with said releasing agent, said applicator including said heat resistant felt, a porous polymer membrane and a heat resistant fluorine-containing polymer film disposed between said felt and said membrane;

binding through thermal fusion said membrane to said felt except for a predetermied portion of said membrane; and sliding said predetermined portion of said membrane. along the surface of said fixing roller.

* * * * *